US008622647B2

(12) United States Patent
Flood, Jr. et al.

(10) Patent No.: US 8,622,647 B2
(45) Date of Patent: Jan. 7, 2014

(54) CURB-MOUNTED STORM SEWER BOX AND METHOD OF MANUFACTURE/REPAIR

(75) Inventors: Robert Flood, Jr., Marquette, MI (US); Joe O. Roell, Marquette, MI (US)

(73) Assignee: Argonics, Inc., Marquette, MI (US)

( * ) Notice: Subject to any disclaimer, the term of this patent is extended or adjusted under 35 U.S.C. 154(b) by 133 days.

(21) Appl. No.: 13/105,489

(22) Filed: May 11, 2011

(65) Prior Publication Data

US 2011/0278211 A1 Nov. 17, 2011

Related U.S. Application Data

(60) Provisional application No. 61/333,537, filed on May 11, 2010.

(51) Int. Cl.
*E01C 11/22* (2006.01)

(52) U.S. Cl.
USPC ..... 404/5

(58) Field of Classification Search
USPC ..... 404/4, 5, 7, 8; 210/163, 170.03; D25/36
See application file for complete search history.

(56) References Cited

U.S. PATENT DOCUMENTS

| | | | | | |
|---|---|---|---|---|---|
| 468,714 | A * | 2/1892 | Whitten | 404/4 |
| 537,047 | A * | 4/1895 | Landis | 404/8 |
| 1,659,830 | A * | 2/1928 | Moyer | 404/8 |
| 1,928,488 | A * | 9/1933 | Hammerschmidt | 52/179 |
| 1,998,514 | A * | 4/1935 | Miller | 404/4 |
| 2,033,028 | A * | 3/1936 | Gaisman | 404/8 |
| 3,250,189 | A * | 5/1966 | Peletz | 404/5 |
| 4,192,625 | A * | 3/1980 | Peletz | 404/5 |
| 4,610,566 | A * | 9/1986 | Albang et al. | 404/4 |
| 4,637,585 | A * | 1/1987 | Picollo | 249/10 |
| 4,986,693 | A * | 1/1991 | Salberg et al. | 404/4 |
| 7,670,080 | B2 * | 3/2010 | Tzaig | 404/5 |

* cited by examiner

*Primary Examiner* — Matthew D Troutman
(74) *Attorney, Agent, or Firm* — Wood, Phillips, Katz, Clark & Mortimer

(57) ABSTRACT

A storm sewer box, and a method of repairing a storm sewer box for directing water into a storm sewer conduit at a curb location, and having a housing with a front, a top and spaced sides. The housing defines a chamber and a front entry opening that communicates to the housing chamber. The housing has a first surface that at least nominally matches an adjacent curb surface at the front of the housing. The housing has: a) at least one component that defines the first surface; and b) a base to which the at least one component is connected.

19 Claims, 2 Drawing Sheets

CURB-MOUNTED STORM SEWER BOX AND METHOD OF MANUFACTURE/REPAIR

CROSS-REFERENCE TO RELATED APPLICATIONS

This application is a non-provisional of U.S. Ser. No. 61/333,537, filed May 11, 2010.

BACKGROUND OF THE INVENTION

1. Field of the Invention

This invention relates to storm sewers and, more particularly, to a curb-mounted box for funnelling water from streets into a storm sewer.

2. Background Art

In many cities, curb-mounted boxes are installed to define inlets to storm sewers at the sides of streets and highways. The inlet boxes are built into the curbs and have vertical and horizontal walls with surfaces nominally matched respectively to vertical and horizontal surfaces on the curb. The vertical face of the box has a rectangular entry opening that communicates to a chamber bounded by the box and in turn to the sewer conduit. The bottom of the entry opening is flush with or below the street grade so that water can flow freely thereinto. Typically, the street surface will be crowned so that water on the street surface flows laterally oppositely towards the curbs. The lateral street edges and curb vertical surface cooperatively funnel water, with this region being sloped towards the box location.

With this well-known construction, the front wall of the box frames the entry opening, with the top, horizontally extending frame portion having vertical and horizontal surfaces that cooperatively produce a corner that is nominally matched to the top corner region of the adjacent curb. Thus, this top frame element, which bridges adjacent curb edges, functions generally in the same manner as the curb.

Street curbs are made from concrete that is designed to withstand forces and impacts as from normal vehicular traffic as well as blades on snow removal equipment. Storm sewer boxes have been cast from concrete to have the same durability. However, by reason of the fact that the entry opening on the box is formed through the front wall thereof, particularly the upper horizontal frame element is susceptible to being damaged upon being impacted, particularly by the edges of blades on snow removal equipment. Even if the concrete forming the front box wall is reinforced so that it is not prone to being broken off, progressive chipping inevitably results that over time produces a jagged edge that may reconfigure the entry opening undesirably and also creates an unsightly external appearance.

It is known to place an angle iron component on the top corner of the box to address the above condition. However, this angle iron piece is prone to being torn off by becoming snagged by snow removal blades. Once removed, the underlying concrete edge is exposed and prone to being compromised, as described above. Further, the protective angle iron piece, once removed, becomes deposited upon the street or adjacent area whereupon it may be dangerously situated in the path of vehicular or pedestrian traffic.

Alternatively, upon being snagged, as by a blade on snow removal equipment, part of the protective angle iron piece may be bent outwardly to project dangerously in the path of a vehicle or pedestrian on foot.

Yet another problem may be encountered upon the protective angle iron piece being broken away from the remainder of the box. With the snow removal vehicles traveling at relatively high rates of speed, the angle iron piece could be propelled dangerously towards adjacent vehicles or individuals on foot.

Once the concrete boxes are compromised, there are number of repair options. One option is to replace the entire box. The replacement box may be of the same construction or alternatively a molded non-concrete structure may be substituted. The assignee herein currently offers the latter type of boxes, as shown on its website www.accu-rise.com. This design commonly is used to replace cast iron boxes.

However, many municipalities wish to use only concrete boxes. In the event that damage is inflicted upon the boxes, the primary options remain to either replace the entire box with a like box or effect repairs of the damaged box, which typically involves reshaping with concrete at least the upper frame component region on the front wall. This reconstruction generally involves replacing the broken away regions of the box with new concrete. This process addresses primarily cosmetic concerns, as the added concrete may not be adhered adequately to the remainder of the concrete to withstand any significant impact.

Regardless of the manner in which compromised boxes are brought up to desired standards, whether by replacement or repair, the exercise is time consuming and expensive. This is particularly a problem since it can be anticipated that repair of concrete boxes will be a large volume, routine activity following each winter season.

SUMMARY OF THE INVENTION

In one form, the invention is directed to a storm sewer box for directing water into a storm sewer conduit at a curb location. The storm sewer box has a housing with a front, a top and spaced sides. The housing has a chamber and a front entry opening that communicates to the housing chamber. The housing has a first surface that at least nominally matches an adjacent curb surface at the front of the housing with the storm sewer box operatively mounted at a curb location. The housing includes: a) at least one component that defines the first surface; and b) a base to which the at least one component is connected. The at least one component is separable from the base to be replaced by at least one other component upon the base.

In one form, the housing has a top opening covered by a separable cover.

In one form, the housing defines a frame around the front entry opening and the frame has contoured surfaces that funnel incoming water into the chamber.

In one form, the at least one component defines a horizontal surface to match an adjacent curb surface.

In one form, the at least one component defines a vertical surface to match an adjacent curb surface.

In one form, the frame fully surrounds the front entry opening.

In one form, the storm sewer box is operatively incorporated into a storm sewer conduit on a roadway with a curb and between spaced edges on the curb.

In one form, the roadway has an upper surface over a road base and the housing has an upwardly facing locking edge that resides below the upper roadway surface.

In one form, the locking edge is defined by a step that is embedded in the road base.

In one form, the at least one component is secured by at least one separable fastener.

In one form, the fastener has joinable parts with one of the joinable parts fixed to the base.

In one form, the housing is formed through a molding process.

In one form, the at least one component is a plurality of components that extend along the top and front of the housing.

The invention is also directed to a method of repairing a storm sewer box that is used to direct water into a storm sewer conduit at a curb location and consists of a housing with a front, top and spaced sides. The housing has a base made from a first material, with the housing defining a chamber and a front entry opening that communicates to the housing chamber. The housing further includes a first surface that at least nominally matches an adjacent curb surface at the front of the housing with the storm sewer box operatively mounted at the curb location. The method includes the steps of: removing a first portion of the housing with a first shape and defining at least a part of the first surface that has been damaged with the storm sewer box operatively mounted at the curb location; and replacing the first portion of the housing with at least one repair component having a second shape that functions in substantially the same manner as the first portion of the housing.

In one form, the first portion of the housing is defined by at least one component having the first shape that is joined to the base.

In one form, the at least one component is made from a second material that is different than the first material.

In one form, the at least one component is made from an elastomeric material.

In one form, the first portion of the housing is integrally formed with the base and removed by being cut from the base.

In one form, the first portion of the housing comprises at least one separate component that is releasably attached to the base.

In one form, the at least one separate component is releasably attached through at least one threaded fastener.

DETAILED DESCRIPTION OF THE PREFERRED EMBODIMENT

Figure 1:
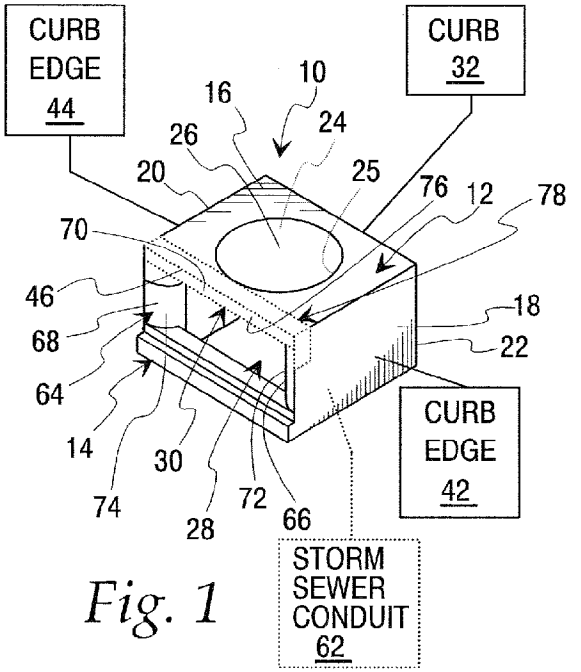
FIG. 1 is a partially schematic, perspective view of a storm sewer box for directing water into a storm sewer conduit at a curb location, according to the present invention.

In FIG. 1, one form of storm sewer box for directing water into a storm sewer conduit at a curb location is shown at 10. The storm sewer box 10 has a housing 12 with a front at 14, a top 16, and laterally spaced sides 18, 20.

Figure 3:
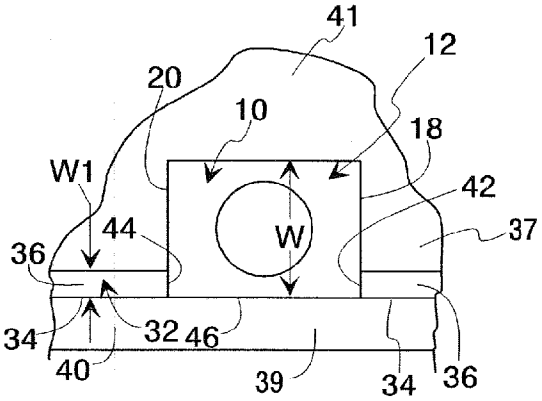
FIG. 3 is a plan view of the storm sewer box operatively mounted between adjacent curb sections and in relationship to an area of the street and adjacent terrain.

The housing 12 has a base 22 with a downwardly recessed seat 24 around an opening 25 in its top 16 to support a separable manhole cover 26. The top 16 of the housing 12 has a width W (FIG. 3), typically on the order of 26 inches. The housing 12 bounds a chamber 28 and defines a front entry opening 30 that communicates to the housing chamber 28.

Figure 2:
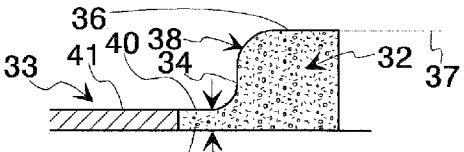
FIG. 2 is a fragmentary, cross-sectional view of a conventional curb and associated gutter on a street or highway into which the storm sewer box of FIG. 1 is incorporated.

The storm sewer box 10 is operatively mounted at a curb location. More specifically, a curb 32, as shown schematically in FIG. 1 and in each of FIGS. 2-6, is provided at the side of a roadway/street 33 and has a vertical front surface 34 and a horizontal top surface 36. The surface 36 is flush with the ground surface 37 adjacent the street 33 and above the street level. The surface 36 typically has a width W1 of 5-6 inches. The surfaces 34, 36 meet at a rounded nose/corner 38. As seen in FIG. 2, the bottom of the curb front blends into a horizontally extending wall 39, having a thickness T on the order of 6 inches and an upper surface 40 that is flush with a street surface 41 as may be defined by an asphalt layer over which vehicular traffic moves. The surfaces 34, 40 cooperatively define a "gutter" that guides water flow along the lengthwise extent of the curb 32 at the side of the street 33.

Typically, the storm sewer box 10 will be integrated into and will reside partially above and partially below the street surface 41, as seen in FIGS. 3-6. The curb 32 will either be cut out or formed so that adjacent, but spaced, edges 42, 44 respectively conform to the sides 18, 20 on the housing 12. The curb top surface 36 will be generally flush with the top 16 of the housing 12 with a top and front corner/nose 46 of the housing 12 bridging the adjacent curb sections and shaped to nominally match the curb nose/corner 38 on each. With this arrangement, a plow, or the like, will be guided smoothly along the vertical curb region at the nose/corner 38 on the curb edge 42, to and along the vertical housing region at the corner/nose 46, and therefrom smoothly to and along the vertical curb region at the nose/corner 38 on the curb edge 44.

The housing 12 has an upwardly facing locking edge 48 defined by a step 50 at the front 14 of the housing 12. With the housing 12 set at its desired operative location, an anchoring element 52 with a projecting anchoring component 54, is embedded in the adjacent road base 56 so that a downwardly facing surface 58 on the anchoring element 52 abuts to the locking edge 48 on the housing 12 to block upward movement of the housing 12 once the same is operatively mounted.

With the sewer box 10 operatively mounted, water from the street surface 41 can flow in the direction of the arrow 60 to and through the front entry opening 30 into the chamber 28 from where the water is directed into a storm sewer conduit 62.

As seen in FIG. 1, the front 14 of the storm sewer box 10 defines a generally rectangular frame 64 around the front entry opening 30. In the depicted embodiment, this frame 64 is defined by three components—spaced vertical side frame components 66, 68, and a horizontally extending upper frame component 70.

The side frame components 66, 68 respectively have contoured/curved front surfaces 72, 74 tending to funnel the incoming water into the chamber 28. The upper frame component 70 has a similarly curved surface 76.

As noted in the Background portion herein, particularly blades on snow removal equipment guided along the curb 32 and storm sewer box 10, may tend to damage the region at the corner/nose 46 on the frame component 70, particularly when the storm sewer box 10 is constructed from concrete. This damage may be progressive or may occur upon a single impact. In any event the result is generally an unsightly appearance at the front of the storm sewer box 10. In a worst case, the depth of the damage may be such that a subsequent pass of a blade may cause the same to shift laterally inwardly to thereby have a greater tendency to further damage the storm sewer box 10 and/or impact and damage the adjacent curb edge 42, 44.

Once the damage occurs, the primary options for repair are to either replace the entire storm sewer box 10 or add material to any part broken away to attempt to re-form the original shape at the corner/nose 46.

Figure 4:
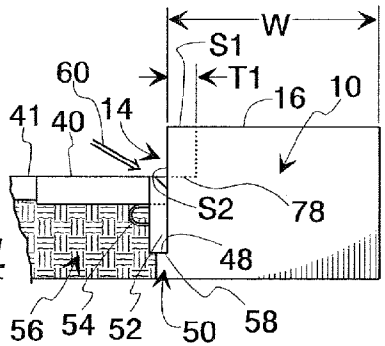
FIG. 4 is a side elevation view of the inventive storm sewer box operatively mounted at a curb location and showing a portion bounded by dotted lines that can be removed or formed to be replaced for repair.
Figure 5:
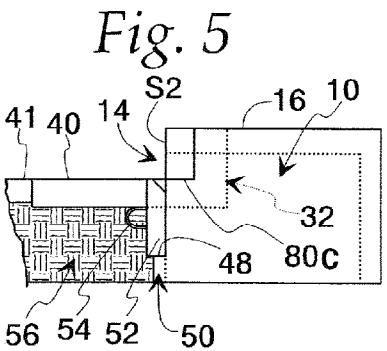
FIG. 5 is a view as in FIG. 4 with repair components in place.

According to the invention, a first portion 78 of the housing 12, as bounded by the dotted lines in FIGS. 1 and 4, is removed. The first portion 78 has a generally rectangular shape in cross-section spanning between the sides 18, 20 on the housing 12 and, in this case, the first portion 78 defines the entire length of the corner/nose 46 that is prone to being damaged.

As shown in FIGS. 5-11, the first portion 78 of the housing 12 is replaced with at least one repair component, and in this case three repair components 80*a*, 80*b*, and 80*c* that cooperatively define an inverted "U" shape. Cooperatively, the repair components 80*a*-80*c* define a shape that is substantially the same as the first portion 78 or at least that is similar enough in shape to function in substantially the same manner as the first portion 78. The components 80*a*, 80*b*, 80*c* cooperatively define horizontal and vertical surfaces S1, S2, that respectively nominally match curb surfaces 36, 34, respectively.

It is preferred, but not required, that the repair components 80*a*-80*c* be made from a different material than that making up the base 22 to which the repair components 80*a*-80*c* are joined. This allows the properties of different materials to be exploited in each component. For example, the base 22 may be made from any material, such as metal, a molded material, such as an elastomeric material, or a composite. As one example, the base 22 might be made from reinforced, or non-reinforced, concrete.

In one preferred form, the repair components 80*a*-80*c* are made from an elastomeric material and are each configured as blocks with substantial fore-and-aft and vertical dimensional thickness. The use of an elastomer is not critical, as the components 80*a*-80*c* might likewise be made from the same types of non-elastomeric materials contemplated for the base 22. The fore-and-aft thickness T1 of the material of the first portion 78 is selected so that the first portion 78 functions as a resilient bumper by reason of the material thereof and block shapes. It has been found that if the thickness T1 is less than three inches, a blade may compress and slice through the material. However, if the thickness T1 is greater than three inches, and preferably on the order of six inches, the material will give adequately so that it is not sliced fully through. Commonly, the blade will produce cuts with a shallow enough depth that the flaps/pieces formed by cutting will spring back so that the material restores to its original shape once the blade passes.

The damaged portion of the housing 12 may be cut out, at the installation site, as by a conventional saw, in the aforementioned shape to accommodate the repair components 80*a*-80*c*.

Figure 6:
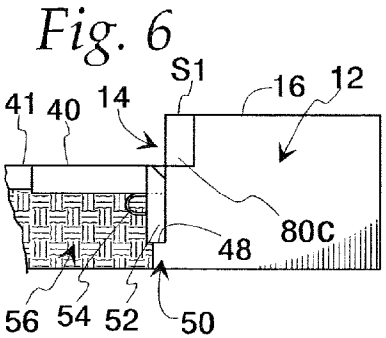
FIG. 6 is a view similar to that in FIG. 5 and with the repair components in place.
Figure 7:
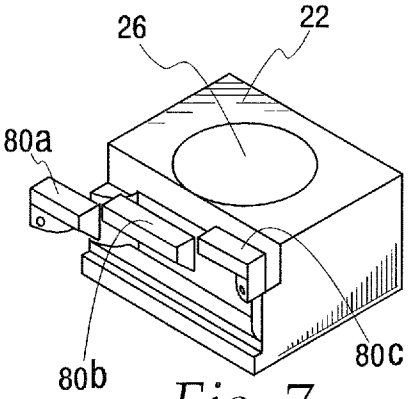
FIG. 7 is an exploded view, from the same perspective as in FIG. 1, with the portion of the storm sewer box removed and showing multiple repair components.
Figure 8:
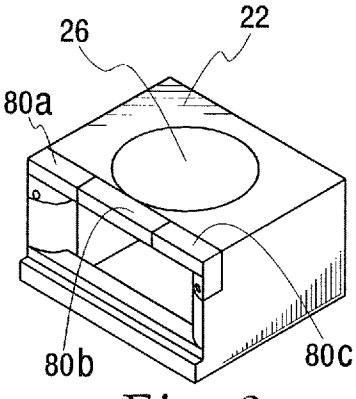
FIG. 8 is a view as in FIG. 7 with the repair components in place.
Figure 9:
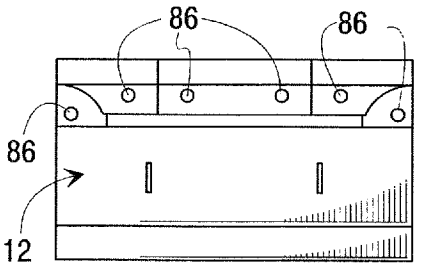
FIG. 9 is an elevation view of a part of the storm sewer box showing mounting holes for fasteners for the repair components.
Figure 10:
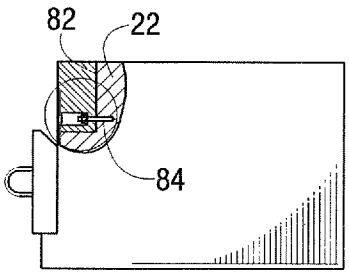
FIG. 10 is a view as in FIGS. 5 and 6 and with the storm sewer box broken away to show a connection between the repair components and a base on the storm sewer box.
Figure 11:
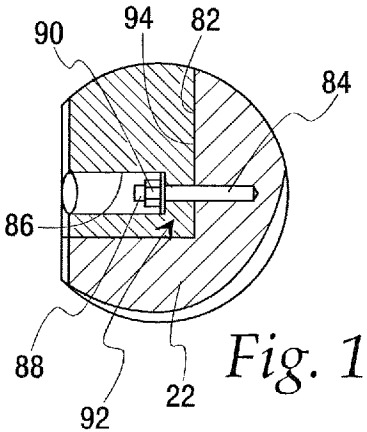
FIG. 11 is an enlarged view of the portion within the circle in FIG. 6.

Alternatively, the housing 12 can initially be made with one or more replaceable components, corresponding in shape and function to the repair components 80*a*-80*c*. These components could be formed in place or could be accommodated by a pre-formed seat 82 of a shape corresponding to the component(s), as shown in FIGS. 6-8. By pre-forming the seat 82, mounting anchors 84, as in the form of threaded fasteners, might be embedded into the base 22. Each of the repair or original components 80*a*-80*c* can have stepped bores 86 into which the threaded ends 88 of the anchors 84 project. A nut 90 can be tightened to the threaded end 88 of each anchor 84 to captively secure a part 92 of each component 80*a*-80*c* against the vertical wall surface 94 bounding the seat 82.

With this latter arrangement, at time of manufacture, the components 80*a*-80*c* can be assembled after formation of the base 22 or otherwise co-formed with the base. In the event that one or more of the components 80*a*-80*c* is damaged, it can be removed on site by loosening the nuts 90 associated with the particular component 80*a*-80*c*. A similar or identical component 80*a*-80*c* can then be used to replace the damaged component(s) 80*a*-80*c*.

As noted above, while the components 80*a*-80*c* are shown as three in number, one, two, or more than three, components might be incorporated consistent with the inventive concepts.

In the event that the anchors 84 are not molded into the base 22, the repair components 80*a*-80*c* in the field might be anchored on site using conventional anchors that may be set by drilling into the concrete, or other material, making up the base 22.

It should also be understood that while an elastomer material is described as preferred for the components 80*a*-80*c*, other materials could be utilized for repair that may be potentially temporary or more permanent in nature. For example, it is conceivable that the repair components 80*a*-80*c* might be made from wood, or other non-concrete material, with the expectation of replacement with a more permanent structure at a later date. While not preferred, concrete could be used to make the components 80*a*-80*c*.

The foregoing disclosure of specific embodiments is intended to be illustrative of the broad concepts comprehended by the invention.

The invention claimed is:

1. A storm sewer box for directing water into a storm sewer conduit at a curb location, the storm sewer box comprising:

a housing having a front, a top and spaced sides, the housing defining a chamber and a front entry opening that communicates to the housing chamber, the housing comprising a first surface that at least nominally matches an adjacent curb surface at the front of the housing with the storm sewer box operatively mounted at a curb location, the housing comprising: a) at least one component that defines at least a part of the first surface; and b) a base to which the at least one component is connected, the at least one component connected to the base using at least one fastener that permits the at least one component to be separated from the base to be replaced by at least one other component upon the base, the at least one component made from a non-metal material with a thickness in a fore-and-aft direction of at least three (3) inches.

2. The storm sewer box according to claim 1 wherein the housing has a top opening covered by a separable cover.

3. The storm sewer box according to claim 1 wherein the housing defines a frame around the front entry opening and the frame has contoured surfaces that funnel incoming water into the chamber.

4. The storm sewer box according to claim 1 wherein the at least one component defines a horizontal surface to match an adjacent curb surface.

5. The storm sewer box according to claim 1 wherein the at least one component defines a vertical surface to match an adjacent curb surface.

6. The storm sewer box according to claim 3 wherein the frame fully surrounds the front entry opening.

7. The storm sewer box according to claim 1 operatively incorporated into a storm sewer conduit on a roadway with a curb and between spaced edges on the curb.

8. The combination according to claim 7 wherein the roadway has an upper surface over a road base and the housing has an upwardly facing locking edge that resides below the upper roadway surface.

9. The combination according to claim 8 wherein the locking edge is defined by a step that is embedded in the road base.

10. The storm sewer box according to claim 1 wherein the at least one fastener comprises joinable parts with one of the joinable parts fixed to the base.

11. The storm sewer box according to claim 1 wherein the housing is formed through a molding process.

12. The storm sewer box according to claim 1 wherein the at least one component comprises a plurality of components that extend along the top and front of the housing and each defines a portion of the first surface.

13. A method of repairing a storm sewer box as recited in claim 1 after the first surface on the storm sewer box has been damaged, wherein the base is made from a first material, the method comprising the steps of:

removing a first portion of the housing with a first shape and defining at least a part of the first surface that has been damaged with the storm sewer box operatively mounted at the curb location; and replacing the first portion of the housing with at least a first repair component having a second shape that functions in substantially the same manner as the first portion of the housing.

14. The method of repairing a storm sewer box according to claim 13 wherein the removed first portion of the housing is defined by the at least one component.

15. The method of repairing a storm sewer box according to claim 13 wherein the at least one component is made from a second material that is different than the first material.

16. The method of repairing a storm sewer box according to claim 13 wherein the at least one component is made from an elastomeric material.

17. The storm sewer box according to claim 1 wherein the at least one component is made from an elastomeric material.

18. A storm sewer box for directing water into a storm sewer conduit at a curb location, the storm sewer box comprising:

a housing having a front, a top and spaced sides, the housing defining a chamber and a front entry opening that communicates to the housing chamber, the housing comprising a first surface that at least nominally matches an adjacent curb surface at the front of the housing with the storm sewer box operatively mounted at a curb location, the housing comprising: a) at least one component that defines the first surface; and b) a base to which the at least one component is connected, the at least one component made in the form of a block made from a non-metallic material and having a fore-and-aft thickness of at least three (3) inches, the at least one component attached to the base using at least one releasable fastener.

19. The storm sewer box according to claim 18 wherein the block is made from an elastomer.

* * * * *